US011204586B1

(12) United States Patent
Ogiwara et al.

(10) Patent No.: US 11,204,586 B1
(45) Date of Patent: Dec. 21, 2021

(54) IMAGE FORMING APPARATUS AND COOLING METHOD THEREOF

(71) Applicant: TOSHIBA TEC KABUSHIKI KAISHA, Tokyo (JP)

(72) Inventors: Takashi Ogiwara, Numazu Shizuoka (JP); Masafumi Yoshida, Sunto Shizuoka (JP); Kazuyoshi Takeshita, Fujinomiya Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/023,697

(22) Filed: Sep. 17, 2020

(51) Int. Cl.
*G03G 21/20* (2006.01)
*G03G 15/00* (2006.01)

(52) U.S. Cl.
CPC ..... *G03G 21/206* (2013.01); *G03G 15/5045* (2013.01); *G03G 2221/1645* (2013.01)

(58) Field of Classification Search
CPC .. G03G 15/5045; G03G 21/20; G03G 21/203; G03G 21/206
USPC ..... 399/38, 44, 91–98
See application file for complete search history.

(56) References Cited

U.S. PATENT DOCUMENTS 8,073,348 B2 * 12/2011 Ozeki ..... G03G 15/065 399/44
9,335,676 B2 * 5/2016 Miyagawa ..... G03G 15/2021
9,417,607 B2 8/2016 Sakurai

* cited by examiner

*Primary Examiner* — Hoan H Tran
(74) *Attorney, Agent, or Firm* — Amin, Turocy & Watson, LLP

(57) ABSTRACT

According to one embodiment, an image forming apparatus includes an image forming unit, a first temperature sensor, a second temperature sensor, a cooling mechanism, and a controller. The first temperature sensor detects the internal temperature of a machine body where the image forming unit is arranged. The second temperature sensor detects the environmental temperature of the environment where the machine body is placed. The cooling mechanism cools the image forming unit. The controller adjusts the cooling capacity of the cooling mechanism based on the result of comparing the internal temperature detected by the first temperature sensor with a first threshold, and the result of comparing the environmental temperature detected by the second temperature sensor with a second threshold lower than the first threshold.

20 Claims, 7 Drawing Sheets

IMAGE FORMING APPARATUS AND COOLING METHOD THEREOF

FIELD

Embodiments described herein relate generally to an image forming apparatus and a cooling method thereof.

BACKGROUND

An image forming apparatus that uses the electrophotographic process is known as a printer, a copying machine, and a multi-function peripheral (MFP). In this type of image forming apparatus, the temperature inside the machine body rises during image formation. Therefore, the image forming apparatus includes a cooling mechanism for cooling the inside of the machine body.

The cooling mechanism is generally an air blast cooling mechanism that cools the inside of the machine body by the flow of wind. The air blast cooling mechanism includes a fan that causes a flow of wind inside the machine body and a motor that drives the fan. The air blast cooling mechanism increases the cooling capacity by increasing the rotation speed of the motor. In the related art, when the internal temperature of the machine body may exceed the temperature specification upper limit of the object to be cooled, the rotation speed of the motor is increased to increase the cooling capacity.

However, increasing the rotation speed of the motor may worsen the noise level. For this reason, there is a demand from the user to minimize the opportunity to increase the cooling capacity.

DETAILED DESCRIPTION

In general, according to one embodiment, an image forming apparatus includes an image forming unit, a first temperature sensor, a second temperature sensor, a cooling mechanism, and a controller. The first temperature sensor detects the internal temperature of a machine body where the image forming unit is arranged. The second temperature sensor detects the environmental temperature of the environment where the machine body is placed. The cooling mechanism cools the image forming unit. The controller adjusts the cooling capacity of the cooling mechanism based on the result of comparing the internal temperature detected by the first temperature sensor with a first threshold, and the result of comparing the environmental temperature detected by the second temperature sensor with a second threshold lower than the first threshold.

First Embodiment

Figure 1:
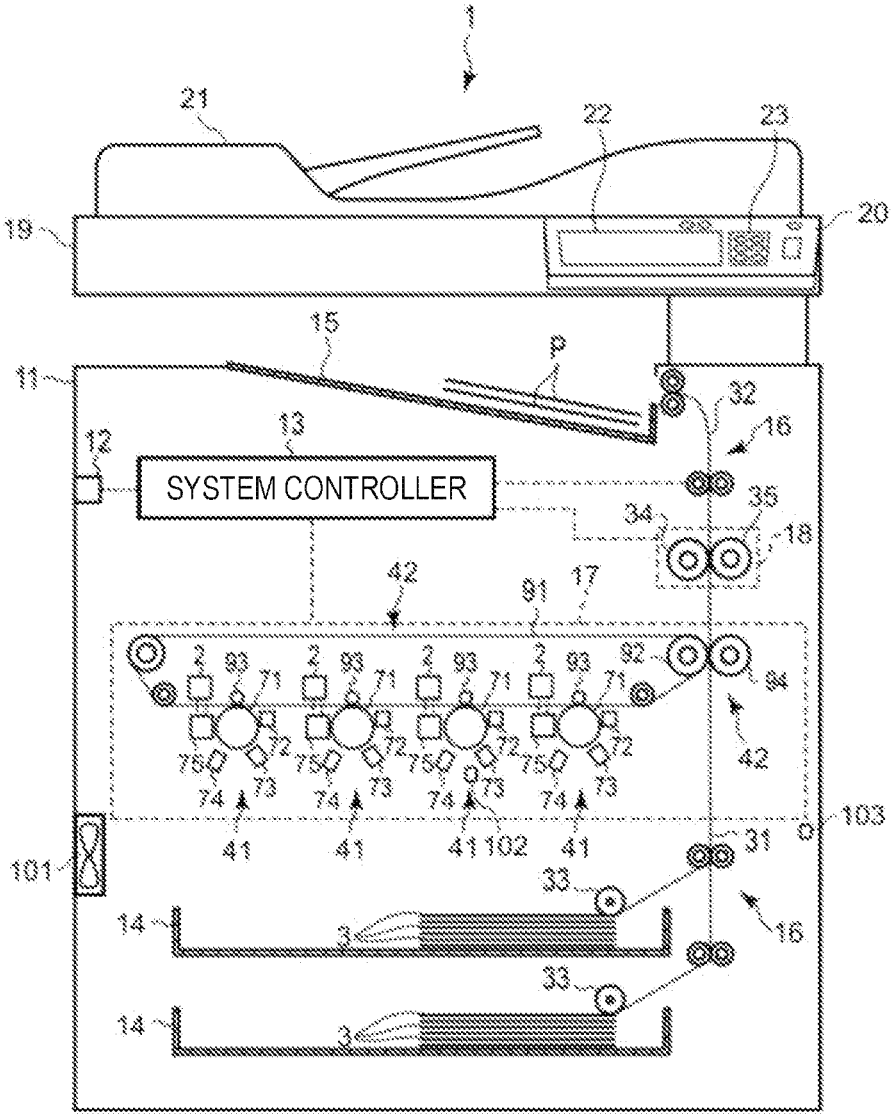
FIG. 1 is a schematic diagram showing a schematic configuration of an image forming apparatus according to an embodiment.

FIG. 1 is a schematic diagram showing a schematic configuration of an image forming apparatus 1 according to a first embodiment.

The image forming apparatus 1 conveys a print medium 3 and forms an image on the print medium 3 by an electrophotographic process. The print medium 3 is also referred to as a recording medium, a transferred body, a sheet, or the like. The image forming apparatus 1 receives toner from a toner cartridge 2 and forms an image on the print medium 3 with the received toner. The toner may be a monochromatic toner or a plurality of color toners such as cyan, magenta, yellow, and black. FIG. 1 shows a multi-function peripheral using four color toners as an example of the image forming apparatus 1.

As shown in FIG. 1, the image forming apparatus 1 includes a machine body 11, a communication interface 12, a system controller 13, a plurality of sheet trays 14, a sheet discharge tray 15, a conveyance unit 16, an image forming unit 17, a fixing unit 18, a scanner unit 19, and a control panel 20.

The machine body 11 is the main body of the image forming apparatus 1. The machine body 11 is also used as a housing. The machine body 11 accommodates, for example, the communication interface 12, the system controller 13, the plurality of sheet trays 14, the sheet discharge tray 15, the conveyance unit 16, the image forming unit 17, the fixing unit 18, and the like.

The communication interface 12 is an interface for communicating with other devices. The communication interface 12 is used, for example, for communication with a higher-level device. The higher-level device is also called an external device. The communication interface 12 is configured of, for example, a LAN connector or the like. The communication interface 12 may perform wireless communication with another device according to a standard such as Bluetooth (registered trademark) or Wi-Fi (registered trademark).

The system controller 13 functions as a control unit of the image forming apparatus 1. The system controller 13 is connected to the communication interface 12. The system controller 13 generates a print job based on, for example, data acquired from an external device via the communication interface 12. The print job includes image data indicating an image to be formed on the print medium 3. The image data may be data for forming an image on one print medium 3 or may be data for forming an image on a plurality of print media 3. The print job may include information indicating color printing or monochrome printing.

The system controller 13 that generated the print job controls the operations of the conveyance unit 16, the image forming unit 17, and the fixing unit 18, and forms the image of the image data included in the print job on the print medium 3. Specifically, the system controller 13 controls conveyance of the print medium 3 by the conveyance unit 16, image formation on the print medium 3 by the image forming unit 17, and fixing of the image on the print medium 3 by the fixing unit 18. As described above, the system controller 13 also has a function as an engine controller of the image forming apparatus 1.

The image forming apparatus 1 may be configured to include an engine controller separately from the system controller 13. In this case, the engine controller controls at least one of conveyance of the print medium 3 by the conveyance unit 16, image formation on the print medium 3 by the image forming unit 17, fixing of an image on the print medium 3 by the fixing unit 18, and the like. The system controller 13 supplies the engine controller with information necessary for the control by the engine controller.

The plurality of sheet trays 14 are cassettes that store the print media 3, respectively. The sheet tray 14 is configured to be able to supply the print medium 3 from outside the machine body 11. For example, the sheet tray 14 is configured to be pulled out from the machine body 11.

The sheet discharge tray 15 is a tray for receiving the print medium 3 discharged from the image forming apparatus 1.

The conveyance unit 16 is a mechanism that conveys the print medium 3 in the image forming apparatus 1. As shown in FIG. 1, the conveyance unit 16 includes a plurality of conveyance paths. For example, the conveyance unit 16 includes a sheet feed conveyance path 31 and a sheet discharge conveyance path 32.

The sheet feed conveyance path 31 and the sheet discharge conveyance path 32 are configured of a plurality of rollers, a plurality of guides, and the like. The plurality of rollers are rotated by the power transmitted from the drive mechanism, thereby conveying the print medium 3. The plurality of guides control the conveyance direction of the print medium 3 conveyed by the rollers.

The sheet feed conveyance path 31 picks up the print medium 3 from the sheet tray 14 and supplies the picked print medium 3 to the image forming unit 17. The sheet feed conveyance path 31 includes a plurality of pickup rollers 33 corresponding to the respective sheet trays 14. Each pickup roller 33 picks up the print medium. 3 of the sheet tray 14 into the sheet feed conveyance path 31.

The sheet discharge conveyance path 32 is a conveyance path for discharging the print medium 3 on which the image was formed by the image forming unit 17 from the machine body 11. The print medium 3 discharged by the sheet discharge conveyance path 32 is supported by the sheet discharge tray 15.

The image forming unit 17 has a configuration for forming an image on the print medium 3. Details of the image forming unit 17 will be described later.

The fixing unit 18 includes a heat roller 34 and a pressure roller 35. The fixing unit 18 heats the print medium 3 conveyed through the sheet discharge conveyance path 32 at a predetermined temperature by the heat roller 34 and further pressurizes the print medium 3 with the pressure roller 35, thereby fixing the image transferred to the print medium 3 onto the print medium 3.

The scanner unit 19 is a device that reads and converts a document into image data, and is installed on the top of the machine body 11. The scanner unit 19 includes an automatic document feeder 21 and is also capable of reading the document conveyed by the automatic document feeder 21.

The control panel 20 includes a touch panel 22 and a keyboard 23. The touch panel 22 is formed by stacking a display such as a liquid crystal display or an organic EL display, and a pointing device that detects a touch input. As the information to be notified to the user of the image forming apparatus 1, for example, an image for setting various functions of the image forming apparatus 1, an image showing the remaining toner amount, and the like are displayed on the display.

The keyboard 23 includes various keys for the user of the image forming apparatus 1 to operate. For example, the keyboard 23 includes a numeric keypad, a power key, a sheet feed key, a function key, and the like. Each key may be referred to as a button. In this way, the touch panel 22 and the keyboard 23 function as an input device of the image forming apparatus 1. The display included in the touch panel 22 functions as a display device of the image forming apparatus 1.

Next, the image forming unit 17 will be described.

As shown in FIG. 1, the image forming unit 17 includes a plurality of processing units 41 and a transfer unit 42. The plurality of processing units 41 are units for forming a toner image. The plurality of processing units 41 are provided for each type of toner. For example, the plurality of processing units 41 correspond to color toners such as cyan, magenta, yellow, and black, respectively. Each processing unit 41 includes a toner cartridge 2 having a color toner of a corresponding color.

Figure 2:
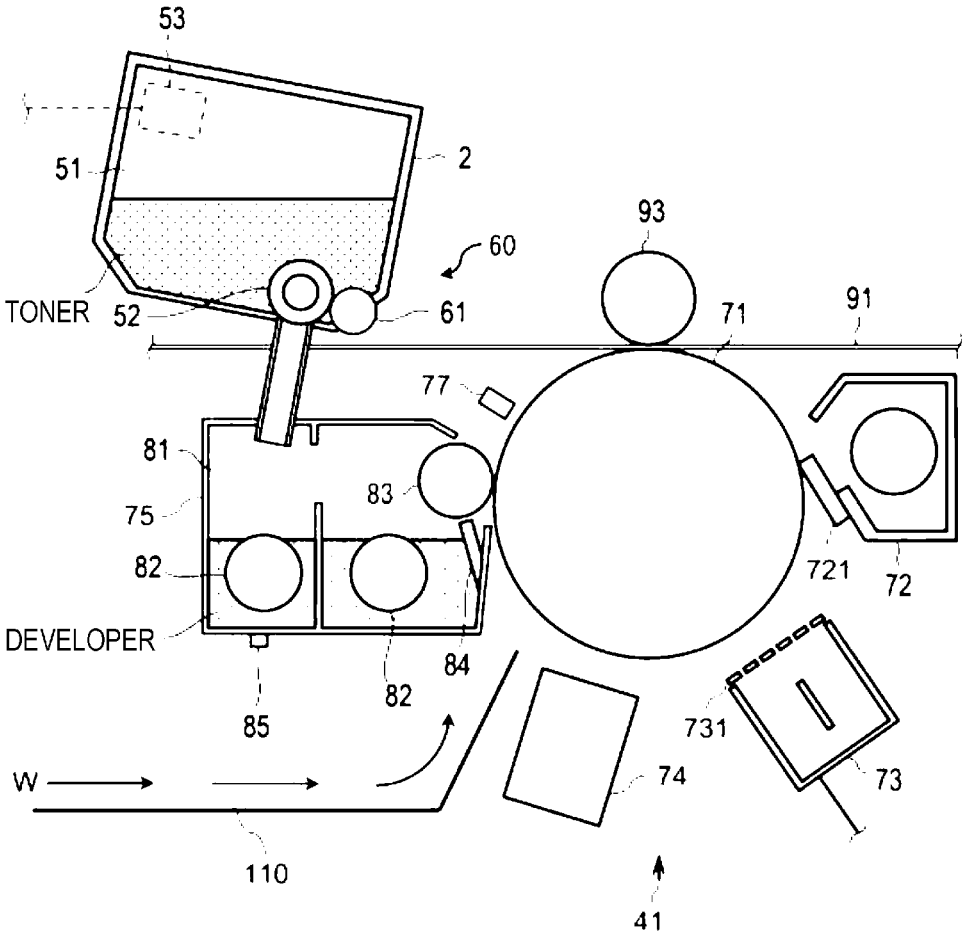
FIG. 2 is a schematic diagram showing a main configuration of an image forming unit.

FIG. 2 is a schematic diagram showing a main configuration of the image forming unit 17. The plurality of toner cartridges 2 and the plurality of processing units 41 have the same configuration, respectively. Therefore, in FIG. 2, one toner cartridge 2, and one processing unit 41 are taken as an example.

First, the toner cartridge 2 will be described. As shown in FIG. 2, the toner cartridge 2 includes a toner container 51, a toner delivery mechanism 52, and a memory 53.

The toner container 51 is a container that stores toner. The toner delivery mechanism 52 is a mechanism for delivering the toner in the toner container 51. The toner delivery mechanism 52 is, for example, a screw provided in the toner container 51. By rotating the screw, the toner in the toner container 51 is sent out.

The toner container 51 is loaded in a loading unit 60. The loading unit 60 is a module in which the toner cartridge 2 filled with toner is mounted. The loading unit 60 includes a toner replenishment motor 61. The loading unit 60 also includes a communication interface that connects the memory 53 of the toner cartridge 2 and the system controller 13.

When the toner cartridge 2 is loaded in the loading unit 60, the toner replenishment motor 61 is connected to the toner delivery mechanism 52 of the toner cartridge 2. The toner replenishment motor 61 drives the toner delivery mechanism 52 under the control of the system controller 13. By driving the toner delivery mechanism 52 by the toner replenishment motor 61, the toner in the toner container 51 is supplied to a developing device 75 described later.

Next, the processing unit 41 will be described. As shown in FIG. 2, the processing unit 41 includes a photosensitive drum 71, a cleaner 72, a charging unit 73, an exposure device 74, and the developing device 75.

The photosensitive drum 71 is a photoconductor including a cylindrical drum and a photosensitive layer formed on the outer peripheral surface of the drum. The photosensitive drum 71 rotates at a constant speed by the power transmitted from the drive mechanism.

The cleaner 72 includes a blade 721 that contacts the surface of the photosensitive drum 71. The cleaner 72 uses the blade 721 to remove the toner remaining on the surface of the photosensitive drum 71.

The charging unit 73 is a device that uniformly charges the surface of the photosensitive drum 71. For example, the charging unit 73 applies the grid bias voltage output from a grid electrode 731 to the photosensitive drum 71 to charge the photosensitive drum 71 to a uniform negative potential. Such a charging unit 73 is also called a charger.

The exposure device 74 includes a plurality of light emitting elements. The light emitting element is, for example, a laser diode (LD), a light emitting diode (LED), an organic EL (OLED), or the like. The plurality of light emitting elements are arranged in the main scanning direction which is a direction parallel to the rotation axis of the photosensitive drum 71. Then, each light emitting element is configured to irradiate one point on the photosensitive drum 71 with light.

The exposure device 74 forms a line of a latent image on the photosensitive drum 71 by irradiating the surface of the charged photosensitive drum 71 with light from the plurality of light emitting elements arranged in the main scanning direction. Further, the exposure device 74 forms a plurality of lines of latent images by continuously irradiating the rotating photosensitive drum 71 with light.

The developing device 75 is a device that adheres toner to the photosensitive drum 71. The developing device 75 includes a developer container 81, a stirring mechanism 82, a developing roller 83, a doctor blade 84, an automatic toner control (ATC) sensor 85, and the like.

The developer container 81 is a container for containing a developer containing a toner and a carrier. The developer container 81 receives the toner sent from the toner cartridge 2 by the toner delivery mechanism 52. The carrier is contained in the developer container 81 when the developing device 75 is manufactured.

The stirring mechanism 82 is inside the developer container 81. The stirring mechanism 82 stirs the toner and the carrier in the developer container 81.

The developing roller 83 rotates in the developer container 81 to adhere the developer to the surface of the roller.

The doctor blade 84 is a member arranged at a predetermined distance from the surface of the developing roller 83. The doctor blade 84 removes part of the developer adhering to the surface of the rotating developing roller 83. As a result, a developer layer having a thickness corresponding to the distance between the doctor blade 84 and the surface of the developing roller 83 is formed on the surface of the developing roller 83.

The ATC sensor 85 is, for example, a magnetic flux sensor having a coil and detecting the voltage value generated in the coil. The detection voltage of the ATC sensor 85 changes depending on the density of magnetic flux from the toner in the developer container 81. That is, the ATC sensor 85 detects a voltage according to the density ratio of the toner in the developer container 81 to the carrier. Such a density ratio is called a toner density. The system controller 13 can determine the toner density in the developer container 81 based on the detection voltage of the ATC sensor 85.

As described above, when the surface of the photosensitive drum 71 charged by the charging unit 73 is irradiated with light from the exposure device 74, a latent image is formed. After that, when the layer of the developer formed on the surface of the developing roller 83 in the developing device 75 approaches the surface of the photosensitive drum 71, the toner contained in the developer adheres to the latent image formed on the surface of the photosensitive drum 71. As a result, a toner image is formed on the surface of the photosensitive drum 71. That is, the exposure device 74 and the developing device 75 form an image forming unit 76 (see FIG. 3).

The transfer unit 42 is configured to transfer the toner image formed on the surface of the photosensitive drum 71 to the print medium 3.

As shown in FIGS. 1 and 2, the transfer unit 42 includes, for example, a transfer belt 91, a secondary transfer counter roller 92, a plurality of primary transfer rollers 93, and a secondary transfer roller 94.

The transfer belt 91 is an endless belt wound around the secondary transfer counter roller 92 and a plurality of winding rollers. The inner surface (inner peripheral surface) of the transfer belt 91 contacts the secondary transfer counter roller 92 and the plurality of winding rollers, and the outer surface (outer peripheral surface) thereof faces the photosensitive drum 71 of the processing unit 41.

The secondary transfer counter roller 92 is rotated by the power transmitted from the drive mechanism. The secondary transfer counter roller 92 conveys the transfer belt 91 in a predetermined conveying direction by rotating. The plurality of winding rollers are configured to be freely rotatable. The plurality of winding rollers rotate as the transfer belt 91 moves by the secondary transfer counter roller 92.

A plurality of primary transfer rollers 93 are provided for each processing unit 41. The plurality of primary transfer rollers 93 are provided to face the photosensitive drums 71 of the corresponding processing units 41, respectively. Specifically, the plurality of primary transfer rollers 93 are provided at positions facing the corresponding photosensitive drums 71 of the processing units 41 with the transfer belt 91 interposed therebetween. The primary transfer roller 93 contacts the inner peripheral surface side of the transfer belt 91 and displaces the transfer belt 91 toward the photosensitive drum 71 side. Due to this displacement, the outer peripheral surface of the transfer belt 91 contacts the photosensitive drum 71.

The secondary transfer roller 94 is provided at a position facing the secondary transfer counter roller 92. The secondary transfer roller 94 contacts the outer peripheral surface of the transfer belt 91 conveyed on the peripheral surface of the secondary transfer counter roller 92 and applies pressure. This contact and pressure form a transfer nip in which the secondary transfer roller 94 and the outer peripheral surface of the transfer belt 91 are in close contact with each other.

By rotating, the secondary transfer roller 94 and the secondary transfer counter roller 92 convey the print medium 3 supplied from the sheet feed conveyance path 31 while interposing the print medium 3. As a result, the print medium 3 passes through the transfer nip. The secondary transfer roller 94 presses the print medium 3 passing through the transfer nip against the outer peripheral surface of the transfer belt 91.

In the transfer unit 42 configured as described above, when the outer peripheral surface of the transfer belt 91 contacts the photosensitive drum 71, the toner image formed on the surface of the photosensitive drum 71 is transferred to the outer peripheral surface of the transfer belt 91. As shown in FIG. 1, when the image forming unit 17 includes a plurality of processing units 41, the transfer belt 91 receives the toner images from the photosensitive drums 71 of the plurality of processing units 41. The toner image transferred onto the outer peripheral surface of the transfer belt 91 is conveyed to the transfer nip by the transfer belt 91. At this time, if the print medium 3 exists in the transfer nip, the toner image transferred to the outer peripheral surface of the transfer belt 91 is transferred to the print medium 3 in the transfer nip.

Each of the plurality of processing units 41 includes a surface potential sensor 77. A plurality of surface potential sensors 77 detect the surface potential of the photosensitive drum 71 in the corresponding processing unit 41. For example, the surface potential sensor 77 includes a potential sensor probe and a shutter that moves between a position where the potential sensor probe is exposed and a position where the potential sensor probe is covered. The surface potential sensor 77 detects the surface potential of the photosensitive drum 71 by the potential sensor probe when the shutter moved to a position where the potential sensor probe is exposed.

Now, the print medium 3 on which the toner image is transferred by the action of the image forming unit 17 is conveyed to the fixing unit 18. Then, by the action of the fixing unit 18, the toner image transferred onto the print medium 3 is fixed onto the print medium 3. In this way, the image forming unit 17 and the fixing unit 18 function as an image forming unit.

The image forming apparatus 1 includes a cooling mechanism 101 for cooling the image forming unit, as shown in FIG. 1. The image forming apparatus 1 also includes a first temperature sensor 102 for detecting the internal temperature of the machine body 11 and a second temperature sensor 103 for detecting the environmental temperature of the environment in which the machine body 11 is placed.

The cooling mechanism 101 is an air blast cooling mechanism that cools an object to be cooled included in the image forming unit in the machine body 11 by, for example, a flow of wind. The cooling mechanism 101 includes a fan 1012 (see FIG. 3) that blows wind into the machine body 11 and a motor 1011 that drives the fan 1012.

The object to be cooled is, for example, the doctor blade 84. As described above, the doctor blade 84 removes part of the developer adhered to the surface of the rotating developing roller 83. Therefore, when the developing roller 83 is repeatedly rotated by continuous sheet passing, frictional heat is generated between the doctor blade 84 and the toner contained in the developer. When the temperature of the doctor blade 84 rises due to this frictional heat, the toner adhered to the doctor blade 84 may be fixed and the developer adhered to the surface of the developing roller 83 may not be removed well. If the performance of removing the developer deteriorates, the thickness of the layer of the developer formed on the surface of the developing roller 83 becomes uneven, and the quality of the formed image deteriorates.

Therefore, in the present embodiment, as shown in FIG. 2, a cooling duct 110 for guiding a wind W sent into the machine body 11 by the cooling mechanism 101 to the installation location of the doctor blade 84 is formed in the machine body 11. The cooling duct 110 is configured to divide the wind W into the installation directions of the doctor blades 84 of the developing devices 75 provided in the respective processing units 41.

The first temperature sensor 102 is arranged at a position that is easily affected by the temperature change inside the machine body 11 due to continuous sheet passing. The first temperature sensor 102 is installed, for example, in the vicinity of any one of the plurality of processing units 41 equipped with the doctor blade 84 that is the object to be cooled.

The second temperature sensor 103 is arranged at a position that is unlikely to be affected by the temperature change inside the machine body 11 due to continuous sheet passing. The second temperature sensor 103 is installed, for example, in the vicinity of the outside air intake port of the machine body 11.

Next, a circuit configuration of a main part of the image forming apparatus 1 will be described.

Figure 3:
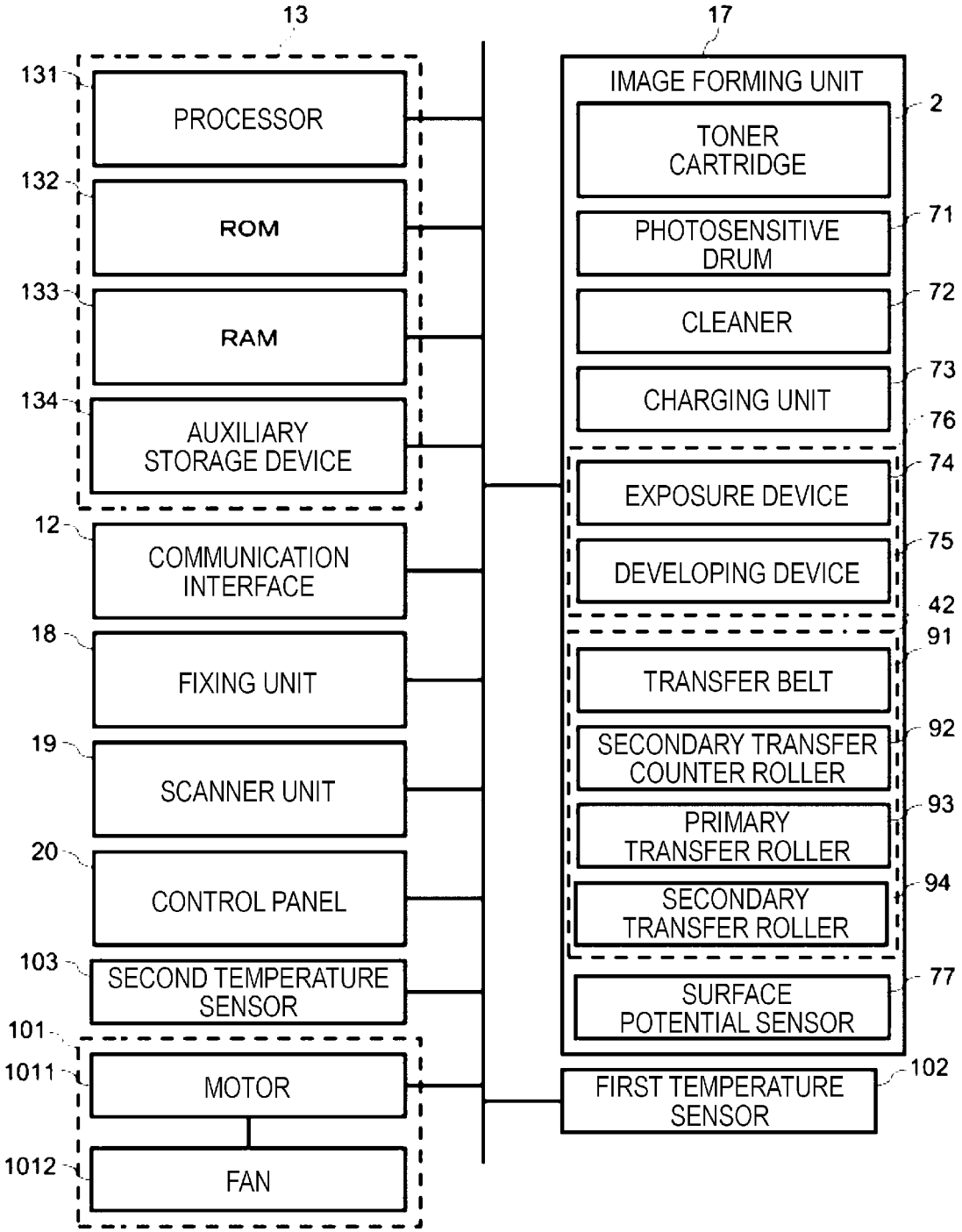
FIG. 3 is a block diagram showing a circuit configuration of a main part of the image forming apparatus.

FIG. 3 is a block diagram showing a circuit configuration of a main part of the image forming apparatus 1. As illustrated, in the image forming apparatus 1, a circuit is configured by connecting the communication interface 12, the image forming unit 17, the fixing unit 18, the scanner unit 19, the control panel 20, the cooling mechanism 101, the first temperature sensor 102, the second temperature sensor 103, and the like to the system controller 13 with a signal line.

The system controller 13 includes a processor 131, a Read Only Memory (ROM) 132, a Random Access Memory (RAM) 133, and an auxiliary storage device 134. The system controller 13 configures a computer by connecting the processor 131, the ROM 132, the RAM 133, and the auxiliary storage device 134 with a signal line.

The processor 131 corresponds to the central part of the computer. The processor 131 controls each unit to realize various functions of the image forming apparatus 1 according to an operating system or an application program. The processor 131 is, for example, a Central Processing Unit (CPU).

The ROM 132 and the RAM 133 correspond to the main storage part of the computer. The ROM 132 is a non-volatile memory area and the RAM 133 is a volatile memory area. The ROM 132 stores an operating system or an application program. The ROM 132 also stores data necessary for the processor 131 to execute processing for controlling each unit. The RAM 133 is used as a work area in which data is appropriately rewritten by the processor 131. The RAM 133 has a work area for storing image data, for example.

The auxiliary storage device 134 corresponds to the auxiliary storage part of the computer. As the auxiliary storage device 134, known storage devices such as Electric Erasable Programmable Read-Only Memory (EEPROM), Hard Disc Drive (HDD) or Solid State Drive (SSD) are used alone or in combination. The auxiliary storage device 134 stores data used by the processor 131 for performing various processes and data generated by the process of the processor 131. The auxiliary storage device 134 may store an application program.

The system controller 13 connects the toner cartridge 2 of the image forming unit 17, the photosensitive drum 71, the cleaner 72, the charging unit 73, the image forming unit (the exposure device 74, the developing device 75) 76, the transfer unit (the transfer belt 91, the secondary transfer counter roller 92, the primary transfer roller 93, the secondary transfer roller 94) 42, and the surface potential sensor 77 to each other by signal lines. Then, the system controller 13 controls the toner cartridge 2, the photosensitive drum 71, the cleaner 72, the charging unit 73 and the image forming unit 76, and the transfer unit 42 and the fixing unit 18, which are provided for each processing unit 41, to form an image on the print medium 3.

The system controller 13 acquires the temperature detected by the first temperature sensor 102 as an internal temperature Q of the machine body 11. The system controller 13 acquires the temperature detected by the second temperature sensor 103 as an environmental temperature P of the environment where the machine body 11 is installed. The system controller 13 controls the rotation speed of the motor 1011 that drives the fan 1012 of the cooling mechanism 101 based on the internal temperature Q and the environmental temperature P. That is, the system controller 13 can adjust the cooling capacity of the cooling mechanism 101 by controlling the rotation speed of the motor 1011.

Then, next, the function of adjusting the cooling capacity by the system controller 13 will be described.

Figure 4:
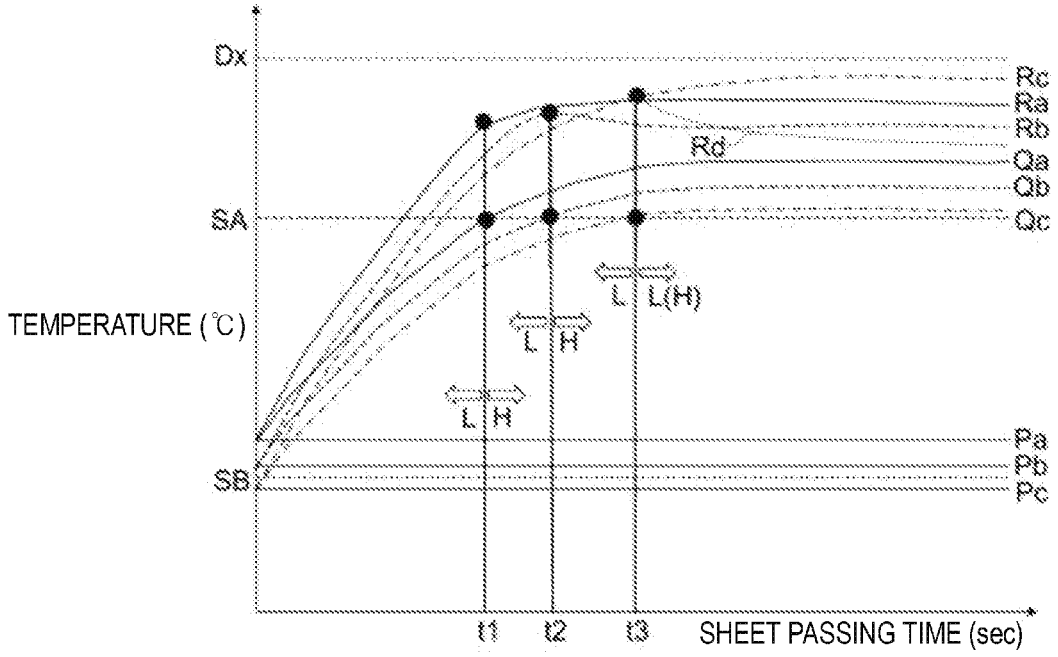
FIG. 4 is a graph for illustrating the temperature change characteristics of a doctor blade.

FIG. 4 is a graph for illustrating the temperature change characteristics of the doctor blade 84 that is the object to be cooled. The vertical axis represents the temperature (° C.). The horizontal axis represents the elapsed time from the print start of the print job, the so-called sheet passing time (sec).

In FIG. 4, a characteristic Pa, a characteristic Pb, and a characteristic Pc all show examples of the environmental temperature P detected by the second temperature sensor 103. The characteristic Pa is a characteristic of the environmental temperature P with respect to the sheet passing time when the temperature of the installation environment is higher than the characteristic Pb. The characteristic Pb is a characteristic of the environmental temperature P with respect to the sheet passing time when the temperature of the installation environment is higher than the characteristic Pc. Below, the air temperature when the environmental temperature P is represented by the characteristic Pa is represented as an air temperature T1, the air temperature when the environmental temperature P is represented by the characteristic Pb is represented as an air temperature T2, and the air temperature when the environment temperature P is represented by the characteristic Pc is represented as an air temperature T3. There is a relationship of T1>T2>T3 among the air temperature T1, the air temperature T2, and the air temperature T3. FIG. 4 exemplifies a case where the air temperature T1, the air temperature T2, or the air temperature T3 does not change within the sheet passing time.

In FIG. 4, a characteristic Qa, a characteristic Qb, and a characteristic Qc all show examples of the internal temperature Q detected by the first temperature sensor 102. The characteristic Qa is a characteristic of the internal temperature Q with respect to the sheet passing time when the installation environment is at the air temperature T1. The characteristic Qb is a characteristic of the internal temperature Q with respect to the sheet passing time when the installation environment is at the air temperature T2. The characteristic Qc is a characteristic of the internal temperature Q with respect to the sheet passing time when the installation environment is at the air temperature T3.

In FIG. 4, a characteristic Ra, a characteristic Rb, a characteristic Rc, and a characteristic Rd all show examples of a surface temperature R of the doctor blade 84. The characteristic Ra is a characteristic of the surface temperature R with respect to the sheet passing time when the installation environment is at the air temperature T1. The characteristic Rb is a characteristic of the surface temperature R with respect to the sheet passing time when the installation environment is at the air temperature T2. The characteristic Rc and the characteristic Rd are both characteristics of the surface temperature R with respect to the sheet passing time when the installation environment is at the temperature T3.

In FIG. 4, a temperature Dx indicates the upper limit of the temperature specification of the doctor blade 84. When the surface temperature R of the doctor blade 84 exceeds the temperature Dx, the toner adhered to the surface is fixed and the image forming quality is deteriorated. Therefore, the system controller 13 needs to adjust the cooling capacity of the cooling mechanism 101 so that the surface temperature R of the doctor blade 84 does not exceed the temperature Dx.

In FIG. 4, a temperature SA is a threshold to be compared with the internal temperature Q. A temperature SB is a threshold to be compared with the environmental temperature P. Hereinafter, the temperature SA will be referred to as a first threshold SA and the temperature SB will be referred to as a second threshold SB. There is a relationship of SA>SB between the first threshold SA and the second threshold SB.

In FIG. 4, a sheet passing time t1 indicates the time when the internal temperature Q indicated by the characteristic Qa reaches the first threshold SA. A sheet passing time t2 indicates the time when the internal temperature Q indicated by the characteristic Qb reaches the first threshold SA. A sheet passing time t3 indicates the time when the internal temperature Q indicated by the characteristic Qc reaches the first threshold SA.

In the present embodiment, the operation mode of the cooling mechanism 101 is set to a low speed mode "L" until the internal temperature Q exceeds the first threshold SA. In the low speed mode "L", the motor 1011 rotates at a low speed. Therefore, since the fan 1012 rotates at a low speed, the cooling capacity of the cooling mechanism 101 is low.

On the other hand, when the internal temperature Q exceeds the first threshold SA, in principle, the operation mode of the cooling mechanism 101 is set to a high speed mode "H". In the high speed mode "H", the motor 1011 rotates at a high speed. Therefore, since the fan 1012 rotates at a high speed, the cooling capacity of the cooling mechanism 101 increases. However, when the environmental temperature is indicated by the characteristic Qc, that is, when the air temperature T3 is lower than the second threshold SB, the low speed mode "L" is maintained.

In FIG. 4, the characteristic Ra is a characteristic of the surface temperature R with respect to the sheet passing time when the operation mode of the cooling mechanism 101 is switched to the high speed mode "H" at the sheet passing time t1. As illustrated, the surface temperature R of the doctor blade 84 indicated by the characteristic Ra is restrained from increasing at the boundary of the sheet passing time t1 when the cooling capacity is increased. Therefore, the surface temperature R does not exceed the temperature Dx even if the sheet passing time is extended. Incidentally, when the low speed mode "L" is maintained even after the sheet passing time t1 is elapsed, it is presumed that the surface temperature R of the doctor blade 84 exceeds the temperature Dx.

In FIG. 4, the characteristic Rb is a characteristic of the surface temperature R with respect to the sheet passing time when the operation mode of the cooling mechanism 101 is switched to the high speed mode "H" at the sheet passing time t2. As illustrated, the surface temperature R of the doctor blade 84 indicated by the characteristic Rb decreases at the boundary of the sheet passing time t2 when the cooling capacity is increased. Therefore, the surface temperature R does not exceed the temperature Dx even if the sheet passing time is extended. Incidentally, when the low speed mode "L" is maintained even after the sheet passing time t2 is elapsed, it is presumed that the surface temperature R of the doctor blade 84 may exceed the temperature Dx.

In FIG. 4, the characteristic Rd is a characteristic of the surface temperature R with respect to the sheet passing time when the operation mode of the cooling mechanism 101 is switched to the high speed mode "H" at the sheet passing time t3, and the characteristic Rc is a characteristic of the surface temperature R with respect to the sheet passing time when the low speed mode "L" is maintained. As illustrated, the surface temperature R of the doctor blade 84 indicated by the characteristic Rd decreases at the boundary of the sheet passing time t3 when the cooling capacity is increased. On the other hand, the surface temperature R of the doctor blade 84 indicated by the characteristic Rc gradually rises because the cooling capacity remains low even after the sheet passing time t3 is elapsed. However, the surface temperature R does not exceed the temperature Dx and eventually becomes saturated. As described above, the surface temperature R of the doctor blade 84 may not exceed the temperature Dx, which is the temperature specification upper limit, regardless of the sheet passing time depending on the air temperature of the installation environment.

Therefore, in this embodiment, the highest temperature of the installation environment is obtained in which the surface temperature R of the doctor blade 84 does not exceed the temperature Dx, which is the temperature specification upper limit, regardless of the sheet passing time. Then, the environmental temperature P detected by the second temperature sensor 103 when the highest temperature or a temperature slightly lower than the highest temperature is set as the second threshold SB.

Further, as indicated by the characteristic Ra, the sheet passing time t1 is obtained in which the surface temperature R of the doctor blade 84 that rises with the passage of sheet passing time in a high-air-temperature installation environment may exceed the temperature Dx, which is the temperature specification upper limit, unless the cooling capacity is increased. Then, the internal temperature Q detected by the first temperature sensor 102 when the sheet passing time t1 or time slightly earlier than the sheet passing time t1 is set as the first threshold SA.

Then, the system controller 13 stores the first threshold SA and the second threshold SB in a threshold storage unit 120 on the auxiliary storage device 134, for example.

Figure 5:
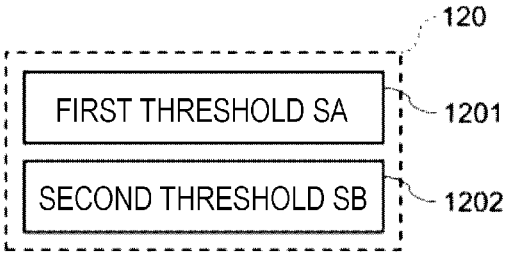
FIG. 5 is a schematic diagram showing a configuration example of a threshold storage unit.

FIG. 5 is a schematic diagram showing a configuration example of the threshold storage unit 120. As shown in FIG. 5, the threshold storage unit 120 includes a first area 1201 for storing the first threshold SA and a second area 1202 for storing the second threshold SB.

The first threshold SA and the second threshold SB can be appropriately changed by, for example, configuring the threshold storage unit 120 on the auxiliary storage device 134 to store the first threshold SA and the second threshold SB. Therefore, when the installation environment of the image forming apparatus 1 changes, the first threshold SA and the second threshold SB may be determined according to the changed environment and the value in the threshold storage unit 120 may be rewritten.

Figure 6:
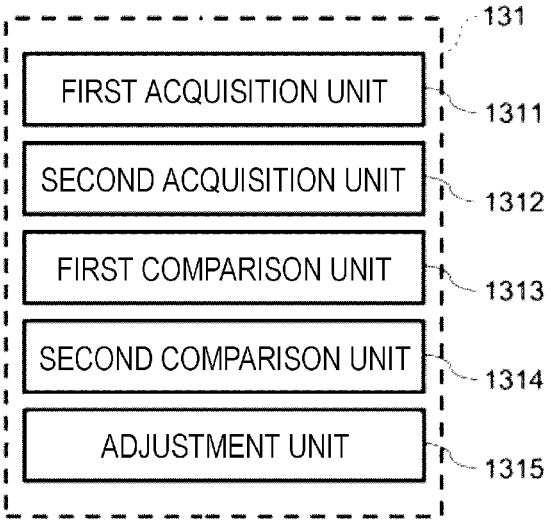
FIG. 6 is a block diagram showing a main functional configuration example of a processor.

FIG. 6 is a block diagram showing an example of the main functional configuration of the processor 131 related to the function of adjusting the cooling capacity by the system controller 13. As shown in FIG. 6, the processor 131 has functions as a first acquisition unit 1311, a second acquisition unit 1312, a first comparison unit 1313, a second comparison unit 1314, and an adjustment unit 1315. The first acquisition unit 1311 has a function of acquiring the internal temperature Q. The second acquisition unit 1312 has a function of acquiring the environmental temperature P. The first comparison unit 1313 has a function of comparing the internal temperature Q with the first threshold SA. The second comparison unit 1314 has a function of comparing the environmental temperature P with the second threshold SB. The adjustment unit 1315 has a function of adjusting the cooling capacity of the cooling mechanism 101.

Next, each function of the processor 131 will be described with reference to the flowchart of FIG. 7.

Figure 7:
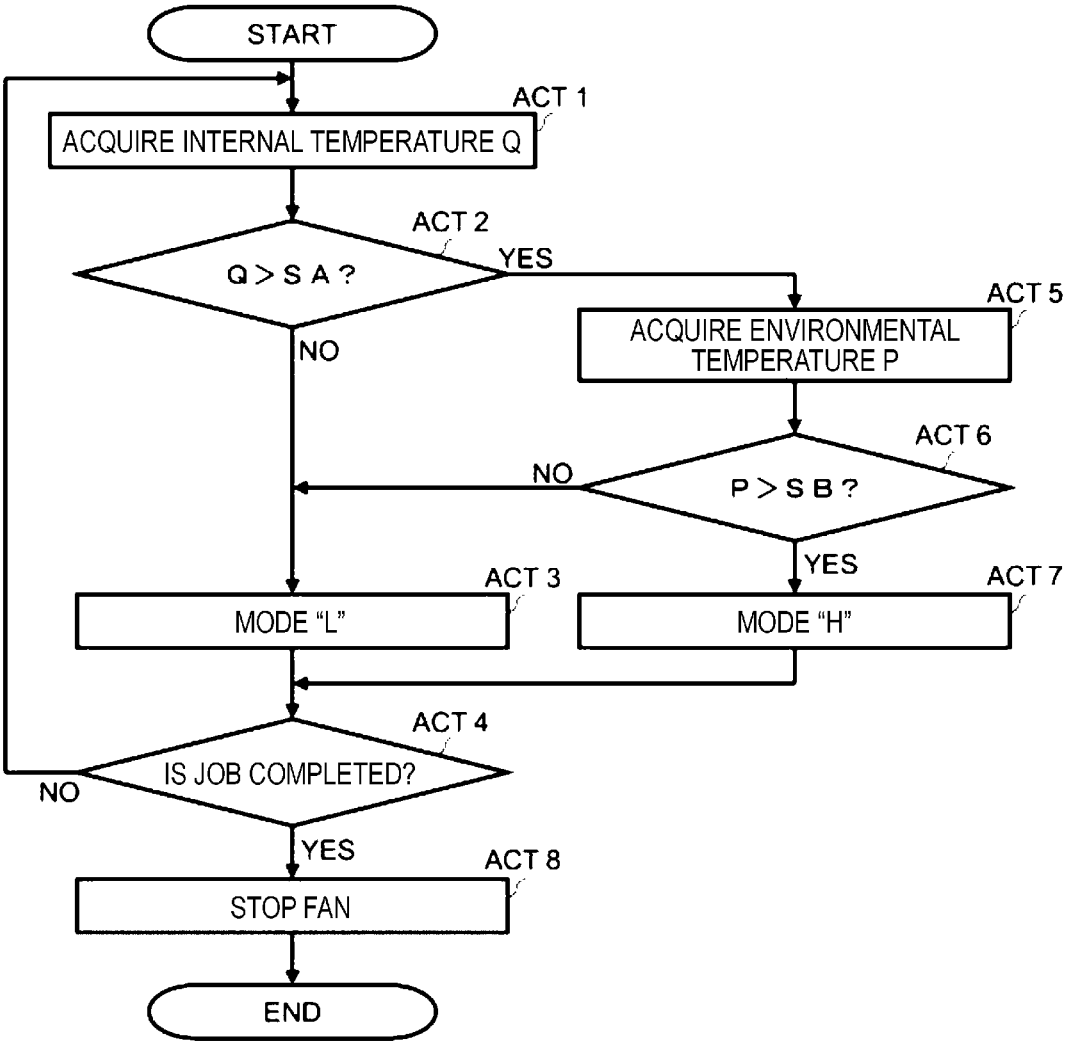
FIG. 7 is a flowchart showing a main procedure of information processing executed by the processor according to a control program in a first embodiment.

FIG. 7 is a flowchart showing a main procedure of information processing executed by the processor 131 according to the control program within a period from the print start of the print job to the end thereof. The control program is stored in the ROM 132 or the auxiliary storage device 134, for example.

When the print start of the print job is instructed, the processor 131 starts the information processing of the procedure shown by the flowchart of FIG. 7. First, the processor 131 acquires the internal temperature Q of the machine body 11 detected by the first temperature sensor 102, as ACT 1. Then, the processor 131 compares the internal temperature Q with the first threshold SA stored in the first area 1201 of the threshold storage unit 120, as ACT 2.

If the internal temperature Q is equal to or lower than the first threshold SA as a result of this comparison, the processor 131 determines NO in ACT 2 and proceeds to ACT 3. The processor 131 sets the operation mode of the cooling mechanism 101 to the low speed mode "L", as ACT 3. As a result, the fan 1012 rotates at a low speed. Therefore, the cooling capacity of the cooling mechanism 101 is low.

The processor 131 checks whether or not the print job is completed, as ACT 4. When the print job is not completed, the processor 131 determines NO in ACT 4 and returns to ACT 1. That is, the processor 131 acquires the internal temperature Q and compares the acquired internal temperature Q with the first threshold SA. If the internal temperature Q is equal to or lower than the first threshold SA as a result of this comparison, the processor 131 maintains the low speed mode "L". That is, the fan 1012 maintains low speed rotation.

As described with reference to FIG. 4, the internal temperature Q rises with the passage of sheet passing time. Then, when the internal temperature Q exceeds the first threshold SA, the processor 131 determines YES in ACT 2 and proceeds to ACT 5. The processor 131 acquires the environmental temperature P detected by the second temperature sensor 103, as ACT 5. Then, the processor 131 compares the environmental temperature P with the second threshold SB stored in the second area 1202 of the threshold storage unit 120, as ACT 6.

If the environmental temperature P exceeds the second threshold SB as a result of this comparison, the processor 131 determines YES in ACT 6 and proceeds to ACT 7. The processor 131 switches the operation mode of the cooling mechanism 101 to the high speed mode "H", as ACT 7. As a result, the fan 1012 rotates at a high speed. Therefore, the cooling capacity of the cooling mechanism 101 is increased.

The processor 131 checks whether or not the print job is completed, as ACT 4. When the print job is not completed, the processor 131 determines NO in ACT 4 and returns to ACT 1. That is, the processor 131 acquires the internal temperature Q and compares the acquired internal temperature Q with the first threshold SA. If the internal temperature Q still exceeds the first threshold SA as a result of this comparison, the processor 131 acquires the environmental temperature P and compares the acquired environmental temperature P with the second threshold SB. In this case, since the environmental temperature P usually exceeds the second threshold SB, the processor 131 maintains the high speed mode "H". That is, the fan 1012 maintains high speed rotation.

If the internal temperature Q is equal to or lower than the first threshold SA as a result of comparing the internal temperature Q with the first threshold SA in ACT 2, the processor 131 returns to the operation mode of the cooling mechanism 101 to the low speed mode "L". This causes the fan 1012 to rotate at a low speed.

On the other hand, if the environmental temperature P is less than or equal to the second threshold SB in ACT 6, the processor 131 determines NO in ACT 6 and proceeds to ACT 3. That is, the processor 131 maintains the low speed mode "L". Therefore, the fan 1012 maintains low speed rotation.

The processor 131 repeatedly executes the processes of ACT 1 to ACT 7 until the print job is completed. Then, when the print job ends, the processor 131 determines YES in ACT 4 and proceeds to ACT 8. The processor 131 commands the cooling mechanism 101 to stop the fan, as ACT 8. By this command, the rotation of the motor 1011 is stopped and the rotation of the fan 1012 is stopped. Thus, the processor 131 ends the information processing for the print job.

In this way, the processor 131 configures the first acquisition unit 1311 by the process of ACT 1 and configures the second acquisition unit 1312 by the process of ACT 5. Further, the processor 131 configures the first comparison unit 1313 by the process of ACT 2 and configures the second comparison unit 1314 by the process of ACT 6. Then, the processor 131 configures the adjustment unit 1315 by the processes of ACT 3 and ACT 7.

As described above in detail, the image forming apparatus 1 according to the first embodiment adjusts the cooling capacity of the cooling mechanism 101 based on the result of comparing the internal temperature Q with the first threshold SA, and the result of comparing the environmental temperature P with the second threshold SB.

Specifically, the processor 131 adjusts the cooling capacity to be high when the internal temperature Q is higher than the first threshold SA and the environmental temperature P is higher than the second threshold SB.

The processor 131 adjusts the cooling capacity to be low when the internal temperature Q is higher than the first threshold SA but the environmental temperature P is equal to or lower than the second threshold SB.

When the internal temperature Q is equal to or lower than the first threshold SA, the processor 131 adjusts the cooling capacity to be low regardless of a result of comparing the environmental temperature P with the second threshold SB.

Therefore, the cooling capacity of the cooling mechanism 101 is adjusted to be high only when the internal temperature Q is higher than the first threshold SA and the environmental temperature P is higher than the second threshold SB. When the internal temperature Q is higher than the first threshold SA and the environmental temperature P is higher than the second threshold SB, there is a concern that the toner adhered to the doctor blade 84, which is the object to be cooled, is fixed and the quality of the formed image deteriorates. However, since the cooling capacity of the cooling mechanism 101 is adjusted to be high, the surface temperature of the doctor blade 84 does not reach the temperature specification upper limit. Therefore, since the toner is not fixed to the doctor blade 84, the quality deterioration of the formed image due to the doctor blade 84 can be prevented.

On the other hand, even though the internal temperature Q becomes higher than the first threshold SA, if the environmental temperature P is equal to or lower than the second threshold SB, the cooling capacity is maintained low. Even though the internal temperature Q is higher than the first threshold SA, if the environmental temperature P is equal to or lower than the second threshold SB, the surface temperature of the doctor blade 84 does not reach the temperature specification upper limit due to continuous sheet passing. Therefore, the problem that the toner adhered to the doctor blade 84 is fixed cannot occur.

As described above, in the image forming apparatus 1, even if the internal temperature Q becomes higher than the first threshold SA, unless the condition that the temperature specification upper limit of the doctor blade 84 as the object to be cooled is reached is satisfied, the cooling capacity of the cooling mechanism 101 is maintained low. Therefore, since the cooling capacity is not unnecessarily increased, the frequency at which the noise level is deteriorated by the high speed rotation of the motor 1011 or the fan 1012 can be suppressed to a low level.

Second Embodiment

Next, a second embodiment of the image forming apparatus 1 will be described.

The difference between the second embodiment and the first embodiment is a part of the information processing procedure executed by the processor 131 according to the control program. Therefore, the contents described with reference to FIGS. 1 to 6 as the first embodiment are also applied to the second embodiment. Therefore, the descriptions thereof are omitted here.

Figure 8:
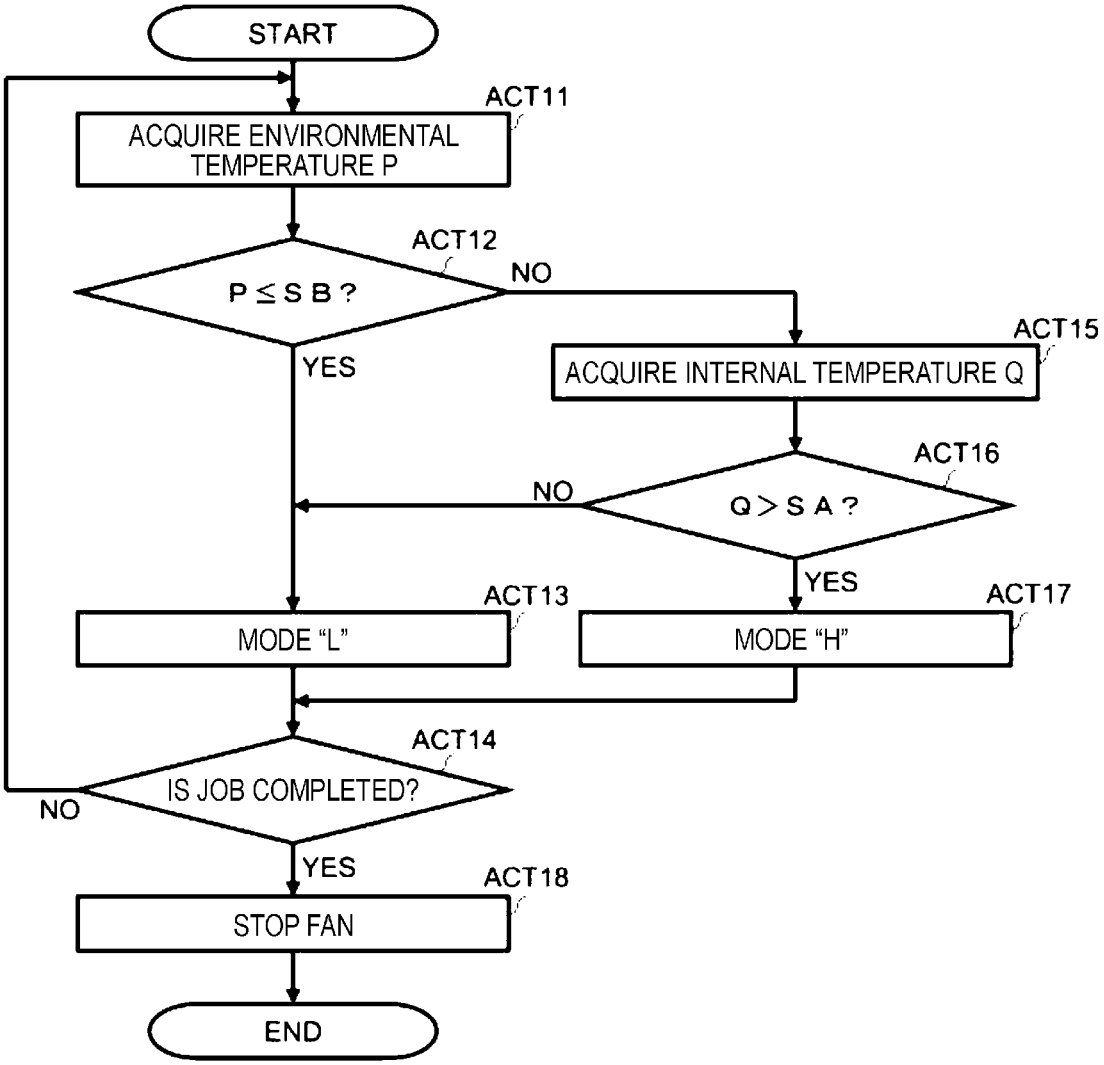
FIG. 8 is a flowchart showing a main procedure of information processing executed by the processor according to a control program in a second embodiment.

FIG. 8 is a flowchart showing a main procedure of information processing executed by the processor 131 in accordance with the control program during the period from the print start of the print job to the end thereof.

When the print start of the print job is instructed, the processor 131 starts the information processing of the procedure shown by the flowchart of FIG. 8. First, the processor 131 acquires the environmental temperature P detected by the second temperature sensor 103, as ACT 11. Then, the processor 131 compares the environmental temperature P with the second threshold SB stored in the second area 1202 of the threshold storage unit 120, as ACT 12.

If the environmental temperature P is equal to or lower than the second threshold SB as a result of this comparison, the processor 131 determines YES in ACT 12 and proceeds to ACT 13. The processor 131 sets the operation mode of the cooling mechanism 101 to the low speed mode "L", as ACT 13. As a result, the fan 1012 rotates at a low speed.

The processor 131 checks whether or not the print job is completed, as ACT 14. When the print job is not completed, the processor 131 determines NO in ACT 14 and returns to ACT 11. That is, the processor 131 acquires the environmental temperature P and compares the acquired environmental temperature P with the second threshold SB. If the environmental temperature P is equal to or lower than the second threshold SB as a result of this comparison, the processor 131 maintains the low speed mode "L". That is, the fan 1012 maintains low speed rotation.

As described with reference to FIG. 4, the environmental temperature P hardly changes while the print job is being executed. Therefore, when the environmental temperature P is equal to or lower than the second threshold SB, the operation mode of the cooling mechanism 101 is maintained in the low speed mode "L".

On the other hand, when the environmental temperature P exceeds the second threshold SB, the processor 131 determines NO in ACT 12 and proceeds to ACT 15. The processor 131 acquires the internal temperature Q of the machine body 11 detected by the first temperature sensor 102, as ACT 15. Then, the processor 131 compares the internal temperature Q with the first threshold SA stored in the first area 1201 of the threshold storage unit 120, as ACT 16.

If the internal temperature Q is equal to or lower than the first threshold SA as a result of this comparison, the processor 131 determines NO in ACT 16 and proceeds to ACT 13. The processor 131 maintains the low speed mode "L".

On the other hand, when the internal temperature Q exceeds the first threshold SA, the processor 131 determines YES in ACT 16 and proceeds to ACT 17. As ACT 17, the processor 131 switches the operation mode of the cooling mechanism 101 to the high speed mode "H". As a result, the fan 1012 rotates at a high speed.

The processor 131 checks whether or not the print job is completed, as ACT 14. When the print job is not completed, the processor 131 determines NO in ACT 14 and returns to ACT 11. Then, the processor 131 executes the processes subsequent to ACT 11 in the same manner as described above.

When the print job ends, the processor 131 determines YES in ACT 14 and proceeds to ACT 18. The processor 131 commands the cooling mechanism 101 to stop the fan, as ACT 18. By this command, the rotation of the motor 1011 is stopped and the rotation of the fan 1012 is stopped. Thus, the processor 131 ends the information processing for the print job.

In this way, the processor 131 configures the second acquisition unit 1312 by the process of ACT 11 and configures the first acquisition unit 1311 by the process of ACT 15. The processor 131 configures the second comparison unit 1314 by the process of ACT 12 and configures the first comparison unit 1313 by the process of ACT 16. Then, the processor 131 configures the adjustment unit 1315 by the processes of ACT 13 and ACT 17.

Also in the image forming apparatus 1 of the second embodiment, the cooling capacity of the cooling mechanism 101 is adjusted based on the result of comparing the internal temperature Q with the first threshold SA, and the result of comparing the environmental temperature P with the second threshold SB.

Specifically, the processor 131 adjusts the cooling capacity of the cooling mechanism 101 to be low regardless of a result of comparing the internal temperature Q and the first threshold SA when the environmental temperature P is equal to or lower than the second threshold SB as a result of comparing the environmental temperature P with the second threshold SB. Therefore, the same operational effect as that of the first embodiment can be obtained.

Although the embodiments of the image forming apparatus 1 have been described above, the embodiment is not limited thereto.

In the above embodiment, the cooling mechanism 101 was described as an air blast cooling mechanism. The cooling mechanism 101 is not limited to the air blast cooling mechanism. For example, a water cooling type cooling mechanism may be used.

In the above embodiment, the object to be cooled is the doctor blade 84. The object to be cooled is not limited to the doctor blade 84. For example, the fixing unit 18 including the heat roller 34 may be the object to be cooled.

The first temperature sensor 102 may be provided for each processing unit 41. In that case, the first acquisition unit 1311 may select the highest internal temperature Q from the internal temperatures Q detected by the plurality of first temperature sensors 102 provided for each processing unit 41.

Similarly, the second temperature sensors 103 may be provided at a plurality of places. Also, in this case, the second acquisition unit 1312 selects the highest environmental temperature P from the environmental temperatures P detected by the plurality of second temperature sensors 103. By doing so, as a result of comparing the environmental temperature P with the second threshold SB in the second comparison unit 1314, the risk of maintaining the low speed mode "L" as the environmental temperature P is equal to or lower than the second threshold SB can be made as small as possible.

In the first embodiment, the processor 131 acquires the environmental temperature P as ACT 5 and compares the environmental temperature P with the second threshold SB as ACT 6. Similarly, in the second embodiment, the processor 131 acquires the environmental temperature P as ACT 11 and compares the environmental temperature P with the second threshold SB as ACT 12. As described above, the environmental temperature P hardly changes while the print job continues. Therefore, as another embodiment, the environmental temperature P is acquired only for the first time. Then, the result of comparing the environmental temperature P with the second threshold SB is stored as flag data. After the second time, the processor 131 skips the processes of ACT 5 or ACT 11 and checks whether the environmental temperature P exceeds the second threshold SB from the flag data, as ACT 6 or ACT 12. By doing so, the number of times the environmental temperature is acquired from the second temperature sensor 103 can be reduced, and thus the processing load of the processor 131 can be reduced.

While certain embodiments have been described, these embodiments have been presented by way of example only, and are not intended to limit the scope of the inventions. Indeed, the novel apparatus and methods described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus, comprising:

an image forming component;

a first temperature sensor configured to detect an internal temperature of the image forming apparatus;

a second temperature sensor configured to detect an environmental temperature of the environment surrounding the image forming apparatus;

a cooling mechanism configured to cool the image forming component; and a controller configured to adjust the cooling capacity of the cooling mechanism based on a result of comparing the internal temperature detected by the first temperature sensor and a first threshold, and a result of comparing the environmental temperature detected by the second temperature sensor and a second threshold, the second threshold lower than the first threshold.

2. The image forming apparatus according to claim 1, wherein the controller increases the cooling capacity of the cooling mechanism when the internal temperature is higher than the first threshold as a result of comparing the internal temperature with the first threshold, and the environmental temperature is higher than the second threshold as a result of comparing the environmental temperature with the second threshold.

3. The image forming apparatus according to claim 1, wherein the controller decreases the cooling capacity of the cooling mechanism when the internal temperature is higher than the first threshold as a result of comparing the internal temperature with the first threshold, and the environmental temperature is equal to or less than the second threshold as a result of comparing the environmental temperature with the second threshold.

4. The image forming apparatus according to claim 1, wherein the controller decreases the cooling capacity of the cooling mechanism regardless of the result of comparing the environmental temperature with the second threshold when the internal temperature is equal to or lower than the first threshold as a result of comparing the internal temperature with the first threshold.

5. The image forming apparatus according to claim 1, wherein the controller decreases the cooling capacity of the cooling mechanism regardless of the result of comparing the internal temperature with the first threshold when the environmental temperature is equal to or lower than the second threshold as a result of comparing the environmental temperature with the second threshold.

6. The image forming apparatus according to claim 1, wherein the controller adjusts the cooling capacity of the cooling mechanism by at least one of increasing a volume of air blown by the cooling mechanism, and decreasing the volume of air blown by the cooling mechanism.

7. The image forming apparatus according to claim 1, wherein the cooling mechanism comprises a fan.

8. A method for an image forming apparatus including an image forming component, a first temperature sensor configured to detect an internal temperature of the image forming apparatus, a second temperature sensor configured to detect an environmental temperature of an environment surrounding the image forming apparatus, a cooling mechanism configured to cool the image forming component, and a controller configured to adjust the cooling capacity of the cooling mechanism, the method comprising:

comparing the internal temperature with a first threshold;

comparing the environmental temperature with a second threshold lower than the first threshold; and adjusting the cooling capacity of the cooling mechanism based on the result of comparing the internal temperature with the first threshold, and the result of comparing the environmental temperature with the second threshold.

9. The method according to claim 8, further comprising:

increasing the cooling capacity of the cooling mechanism when the internal temperature is higher than the first threshold and the environmental temperature is higher than the second threshold.

10. The method according to claim 8, further comprising:

decreasing the cooling capacity of the cooling mechanism when the environmental temperature is equal to or lower than the second threshold even though the internal temperature is higher than the first threshold.

11. The method according to claim 8, further comprising:

decreasing the cooling capacity of the cooling mechanism regardless of the result of comparing the environmental temperature with the second threshold when the internal temperature is equal to or lower than the first threshold.

12. The method according to claim 8, further comprising:

decreasing the cooling capacity of the cooling mechanism regardless of the result of comparing the internal temperature and the first threshold when the environmental temperature is equal to or lower than the second threshold.

13. The method according to claim 8, wherein the second threshold is lower than the first threshold.

14. A temperature regulating system for an image forming apparatus, comprising:

a first temperature sensor configured to detect an internal temperature of the image forming apparatus;

a second temperature sensor configured to detect an environmental temperature of the environment surrounding the image forming apparatus;

a cooling mechanism configured to cool an interior of the image forming apparatus; and a controller configured to adjust the cooling capacity of the cooling mechanism based on a result of comparing the internal temperature detected by the first temperature sensor and a first threshold, and a result of comparing the environmental temperature detected by the second temperature sensor and a second threshold, the second threshold lower than the first threshold.

15. The temperature regulating system according to claim 14, wherein the controller increases the cooling capacity of the cooling mechanism when the internal temperature is higher than the first threshold as a result of comparing the internal temperature with the first threshold, and the environmental temperature is higher than the second threshold as a result of comparing the environmental temperature with the second threshold.

16. The temperature regulating system according to claim 14, wherein the controller decreases the cooling capacity of the cooling mechanism when the internal temperature is higher than the first threshold as a result of comparing the internal temperature with the first threshold, and the environmental temperature is equal to or less than the second threshold as a result of comparing the environmental temperature with the second threshold.

17. The temperature regulating system according to claim 14, wherein the controller decreases the cooling capacity of the cooling mechanism regardless of the result of comparing the environmental temperature with the second threshold when the internal temperature is equal to or lower than the first threshold as a result of comparing the internal temperature with the first threshold.

18. The temperature regulating system according to claim 14, wherein the controller decreases the cooling capacity of the cooling mechanism regardless of the result of comparing the internal temperature with the first threshold when the environmental temperature is equal to or lower than the second threshold as a result of comparing the environmental temperature with the second threshold.

19. The temperature regulating system according to claim 14, wherein the controller adjusts the cooling capacity of the cooling mechanism by at least one of increasing a volume of air blown by the cooling mechanism, and decreasing the volume of air blown by the cooling mechanism.

20. The temperature regulating system according to claim 14, wherein the cooling mechanism comprises a fan.

* * * * *